US009644901B2

(12) United States Patent
Piesker

(10) Patent No.: US 9,644,901 B2
(45) Date of Patent: May 9, 2017

(54) ACCUMULATOR ARRANGEMENT FOR STORING A REFRIGERATING MEDIUM, AND METHOD OF OPERATING SUCH AN ACCUMULATOR ARRANGEMENT

(71) Applicant: AIRBUS OPERATIONS GMBH, Hamburg (DE)

(72) Inventor: Markus Piesker, Lueneburg (DE)

(73) Assignee: AIRBUS OPERATIONS GMBH, Hamburg (DE)

( * ) Notice: Subject to any disclaimer, the term of this patent is extended or adjusted under 35 U.S.C. 154(b) by 511 days.

(21) Appl. No.: 13/743,448

(22) Filed: Jan. 17, 2013

(65) Prior Publication Data

US 2013/0160979 A1 Jun. 27, 2013

Related U.S. Application Data

(63) Continuation-in-part of application No. 13/428,164, filed on Mar. 23, 2012, now Pat. No. 8,875,525.
(Continued)

(30) Foreign Application Priority Data

Mar. 24, 2011 (DE) ..... 10 2011 014 954

(51) Int. Cl.
*F25B 43/00* (2006.01)
*F28F 9/00* (2006.01)
*F25B 9/00* (2006.01)

(52) U.S. Cl.
CPC ..... *F28F 9/00* (2013.01); *F25B 43/006* (2013.01); *F25B 9/008* (2013.01)

(58) Field of Classification Search
CPC .. F25B 43/006; F25B 40/02; F25B 2400/051; F25B 2400/053; F25B 2400/26; F25B 2400/16
See application file for complete search history.

(56) References Cited

U.S. PATENT DOCUMENTS 2,183,346 A 12/1939 Buchanan
4,694,662 A * 9/1987 Adams ..... 62/509
(Continued)

FOREIGN PATENT DOCUMENTS

DE 10 2006 005 035 B3 9/2007
DE 10 2009 011 797 A1 9/2010

*Primary Examiner* — Cassey D Bauer
(74) *Attorney, Agent, or Firm* — Carter, DeLuca, Farrell & Schmidt, LLP

(57) ABSTRACT

An accumulator arrangement suitable for use in a cooling system designed for operation with a two-phase refrigerating medium, includes an accumulator vessel with a receptacle for receiving a refrigerating medium. A liquefier of the accumulator arrangement is adapted to liquefy refrigerating medium to be received into the receptacle of the accumulator vessel before fed in the receptacle of the accumulator vessel and includes a refrigerating medium outlet for discharging refrigerating medium which liquefied in the liquefier from the liquefier. The accumulator arrangement includes a heat exchanger arranged in the receptacle of the accumulator vessel and a refrigerating medium inlet connected to the refrigerating medium outlet of the liquefier for feeding refrigerating medium liquefied in the liquefier into the heat exchanger, and a refrigerating medium outlet which opens into the receptacle of the accumulator vessel for discharging refrigerating medium from the heat exchanger into the receptacle of the accumulator vessel.

26 Claims, 6 Drawing Sheets

Related U.S. Application Data

(60) Provisional application No. 61/466,971, filed on Mar. 24, 2011.

(56) References Cited

U.S. PATENT DOCUMENTS

| | | | | |
|---|---|---|---|---|
| 6,125,652 | A * | 10/2000 | Vogel et al. | 62/509 |
| 8,875,525 | B2 * | 11/2014 | Piesker | 62/84 |
| 2009/0107163 | A1 * | 4/2009 | Lu et al. | 62/291 |

* cited by examiner

ACCUMULATOR ARRANGEMENT FOR STORING A REFRIGERATING MEDIUM, AND METHOD OF OPERATING SUCH AN ACCUMULATOR ARRANGEMENT

CROSS REFERENCE TO RELATED APPLICATIONS

This application is a continuation in part of U.S. patent application Ser. No. 13/428,164 filed Mar. 23, 2012, which claims the benefit of and priority to German Patent Application No. 10 2011 014 954.6 and U.S. Provisional Application No. 61/466,971 both filed on Mar. 24, 2011, each of which are hereby incorporated by reference herein in their entirety.

TECHNICAL FIELD

The invention concerns an accumulator arrangement for storing a refrigerating medium which circulates in a cooling circuit of a cooling system, said accumulator arrangement being suitable in particular for use in a cooling system for cooling food on board an aircraft, said cooling system being designed for operation with a two-phase refrigerating medium. The invention also concerns a method of operating such an accumulator arrangement.

BACKGROUND OF RELATED ART

For operation with a two-phase refrigerating medium, suitable cooling systems are known from DE 10 2006 005 035 B3 and DE 10 2009 011 797 A1, and are used, for example, to cool food which is stored on board a passenger aircraft and intended to be given out to the passengers. Typically, the food which is provided to supply the passengers is kept in mobile transport containers. These transport containers are filled outside the aircraft, precooled, and after being loaded into the aircraft put into appropriate positions in the aircraft passenger cabin, e.g. the on-board kitchens. To ensure that the food remains fresh until it is given out to the passengers, cooling stations, which are supplied with cooling energy from a central cold-generating device and deliver this cooling energy to the transport containers with the food stored in them, are provided in the region of the transport container positions.

Compared with cold-generating units in the form of units at the individual transport container positions, a cooling system with a central cold-generating device has the advantages of a smaller installed volume and lower weight, and also costs less to assemble and maintain. Also, if a cooling system with a central cold-generating device which is arranged outside the passenger cabin is used, machine noises which are generated by cold-generating units placed in the region of the transport container positions, and which are audible in the passenger cabin and can thus be experienced as disturbing, can be avoided.

In the case of the cooling systems which are known from DE 10 2006 005 035 B3 and DE 10 2009 011 797 A1, the phase transitions of the refrigerating medium which flows through the cooling circuit of the cooling systems, said phase transitions occurring in operation of the system, make it possible to use the occurring latent heat consumption for cooling purposes. The refrigerating medium mass flow which is required to provide a desired cooling power is therefore significantly less than in, for example, a liquid cooling system in which a single-phase liquid refrigerating medium is used. Consequently, the cooling systems which are described in DE 10 2006 005 035 B3 and DE 10 2009 011 797 A1 can have smaller conduit cross-sections than a liquid cooling system with comparable cooling power. The reduction of the refrigerating medium mass flow also makes it possible to reduce the conveying power which is required to convey the refrigerating medium through the cooling circuit of the cooling system. The result of this is increased efficiency of the system, since less energy is necessary to operate a corresponding conveying device, e.g. a pump, and also less additional heat, which is generated by the conveying device in operation of the conveying device, must be carried away from the cooling system.

In the case of the cooling systems which are known from the prior art, the two-phase refrigerating medium is usually stored temporarily in the form of a boiling liquid, in accumulator vessels which are integrated into the cooling circuits of the cooling systems. To prevent the refrigerating medium evaporating when it is sucked through a conveying device, e.g. in the form of a pump, it is therefore necessary to subcool the refrigerating medium which is stored temporarily in the accumulator vessels correspondingly. This is usually done by a pressure increase, which is achieved by a suction nozzle of the conveying device being arranged in a defined position below a sump of the accumulator vessel, from which the refrigerating medium which is stored temporarily in the accumulator vessel is discharged from the accumulator vessel. In other words, the conveying device is positioned relative to the accumulator vessel in such a way that for the conveying device a positive minimum inflow level, which is defined by the height of a liquid column over a leading edge of a rotating blade of the conveying device, is maintained. The gravitational force of the liquid column causes a defined pressure increase in the refrigerating medium which is fed into the conveying device, and in this way ensures subcooling of the refrigerating medium, and prevents evaporation of the refrigerating medium.

However, when a cooling system is fitted in an aircraft, the problem often occurs that it is difficult to house the system components in the very restricted installation space, or even, as described above, to position them relative to each other in such a way that, for example, by exploiting the gravitational force of a liquid column over a leading edge of a rotating blade of a conveying device a pressure increase in the refrigerating medium which is fed to the conveying device can be achieved, and thus evaporation of the refrigerating medium because of a pressure reduction caused by the conveying device can be prevented.

SUMMARY

The invention is based on the object of providing a suitable accumulator arrangement for storing refrigerating medium which circulates in a cooling circuit of the cooling system, said accumulator arrangement being suitable for use in a cooling system which is designed for operation with a two-phase refrigerating medium, and said accumulator arrangement making flexible positioning of the individual cooling system components possible. The invention is also based on the object of giving a method of operating such an accumulator arrangement.

This object is achieved by an accumulator arrangement with the features of claim 1 and a method of operating an accumulator arrangement with the features of claim 8.

An accumulator arrangement according to the invention, which in particular is suitable for use in a cooling system which is designed for operation with a two-phase refrigerating medium, e.g. a cooling system for cooling food on board an aircraft, comprises an accumulator vessel with a receptacle which is arranged in an interior of the accumulator vessel, for receiving a refrigerating medium. In operation of a cooling system which is equipped with the accumulator arrangement, the accumulator vessel can be used to receive and store temporarily refrigerating medium which in operation of the cooling system circulates in a cooling circuit of the cooling system.

The refrigerating medium to be received in the receptacle of the accumulator vessel is preferably a refrigerating medium which, when its cooling energy is transferred to a device to be cooled, is converted from the liquid to the gaseous aggregate state, and which can then be reset by corresponding pressure and temperature control into the liquid aggregate state. For example, the receptacle of the accumulator vessel can be adapted to receive $CO_2$ or R134A ($CH_2F—CF_3$) as the refrigerating medium. In the receptacle of the accumulator vessel, the refrigerating medium is usually present in the form of a boiling liquid. The receptacle and/or a jacket which surrounds the receptacle must therefore be designed so that that they can resist the pressure of the refrigerating medium which is present in the form of a boiling liquid without being damaged.

The accumulator arrangement according to the invention also includes a liquefier, which is adapted to liquefy refrigerating medium to be received in the receptacle of the accumulator vessel before it is fed into the receptacle of the accumulator vessel. The liquefier includes a refrigerating medium outlet to discharge refrigerating medium liquefied in the liquefier from the liquefier. The liquefier, which is formed separate from the accumulator vessel of the accumulator arrangement, can, for example, include a heat exchanger which is arranged in its interior, and which a further refrigerating medium flows through. The further refrigerating medium can, for example, be cooled to a desired low temperature by a cold-generating device which is formed separate from the accumulator arrangement, before being fed into the liquefier. As the further refrigerating medium, a liquid refrigerating medium can be used, but also a two-phase refrigerating medium, in particular $CO_2$ or R134A. If desired, the heat exchanger of the liquefier can be operated with the same refrigerating medium as is also provided for reception in the receptacle of the accumulator vessel. By heat transfer to the further refrigerating medium which flows through the heat exchanger of the liquefier, refrigerating medium which is fed into the liquefier and received in an interior of the liquefier, and which is intended to be fed into the receptacle of the accumulator vessel, can be converted from the gaseous state of aggregation to the liquid state of aggregation.

Finally, the accumulator arrangement according to the invention includes a heat exchanger, which is arranged in the receptacle of the accumulator vessel, and which includes a refrigerating medium inlet which is connected to the refrigerating medium outlet of the liquefier for feeding refrigerating medium liquefied in the liquefier into the heat exchanger.

The heat exchanger also includes a refrigerating medium outlet which opens into the receptacle of the accumulator vessel, for discharging refrigerating medium from the heat exchanger into the receptacle of the accumulator vessel. In other words, the accumulator arrangement according to the invention includes a heat exchanger through which refrigerating medium liquefied in the liquefier flows in operation of the accumulator arrangement. After flowing through the heat exchanger, the refrigerating medium leaves the heat exchanger and is fed into the receptacle of the accumulator vessel. The heat exchanger can, for example, include a spirally or conically wound pipe coil, and be provided with lamellae which are arranged in the region of its outer surfaces. A coaxial configuration of the heat exchanger is also conceivable.

The heat exchanger which is arranged in the receptacle of the accumulator vessel ensures that the refrigerating medium which is discharged from the receptacle of the accumulator vessel is always sufficiently subcooled to ensure that the refrigerating medium is always fed in the liquid state to a conveying device for discharging refrigerating medium from the receptacle of the accumulator vessel. Damage caused to the conveying device by gaseous refrigerating medium, or refrigerating medium which is present in the form of wet steam, can thus be reliably avoided. Consequently, it is no longer necessary to arrange the accumulator vessel and the conveying device for discharging refrigerating medium from the receptacle of the accumulator vessel relative to each other so that a positive minimum inflow level is maintained for the conveying device. In this way, a flexible arrangement of the individual components of a cooling system which is equipped with the accumulator arrangement according to the invention is made possible. The cooling system can therefore be housed better in the very restricted installation space which is available on board an aircraft.

The refrigerating medium outlet of the liquefier is preferably arranged in the region of a sump of the liquefier. This makes it possible to discharge refrigerating medium liquefied in the liquefier from the liquefier, driven by gravity. Also, the refrigerating medium outlet of the liquefier and the refrigerating medium inlet of the heat exchanger may be arranged at the same height relative to each other. With such a configuration, the gravitational force of a liquid column in the interior of the liquefier is sufficient to convey the refrigerating medium liquefied in the liquefier into the heat exchanger.

In contrast, the refrigerating medium outlet of the heat exchanger is preferably arranged above the refrigerating medium outlet of the liquefier and/or above the refrigerating medium inlet of the heat exchanger. Thus feeding refrigerating medium through the refrigerating medium outlet of the heat exchanger into the receptacle of the accumulator vessel is possible only if a liquid column in the liquefier has a specified height, and consequently the gravitational force of this liquid column is sufficient to convey the refrigerating medium out of the liquefier, through the heat exchanger, into the receptacle of the accumulator vessel.

The heat exchanger may comprise a first section and a second section which is arranged downstream from the first section. The second section of the heat exchanger may, for example, open into the refrigerating medium outlet of the heat exchanger, i.e. extend as far as the refrigerating medium outlet of the heat exchanger. Preferably, the first section of the heat exchanger is arranged below the refrigerating medium outlet of the liquefier, and consequently preferably also below the refrigerating medium inlet of the heat exchanger, so that refrigerating medium which is fed from the refrigerating medium outlet of the liquefier into the heat exchanger can flow through the first section of the heat exchanger in a first direction, driven by gravity. In contrast, the second section of the heat exchanger is preferably positioned relative to the first section of the heat exchanger so that refrigerating medium can flow through it in a second direction opposite to the first direction. In other words, the second section of the heat exchanger is preferably positioned so that the refrigerating medium must flow through it against gravity, i.e. from below to above. Consequently, conveying refrigerating medium through the second section of the heat exchanger is possible only if a liquid column in the liquefier is sufficiently high, and consequently a sufficiently high gravitational force is available to convey the refrigerating medium through the second section of the heat exchanger.

The accumulator arrangement according to the invention may include a further accumulator vessel with a receptacle for receiving a refrigerating medium, and a further heat exchanger which is arranged in the receptacle of the further accumulator vessel. By providing a further accumulator vessel and a further heat exchanger, the storage capacity of the accumulator arrangement for the refrigerating medium can be increased, so that the accumulator arrangement can be used even in cooling systems with great cooling capacity.

In a first configuration of a accumulator arrangement equipped with a further accumulator vessel and a further heat exchanger, a refrigerating medium inlet of the further heat exchanger may be connected to a sump of the accumulator vessel, so that refrigerating medium can be conveyed out of the accumulator vessel into the further heat exchanger by the gravitational force of the liquid column in the accumulator vessel. A refrigerating medium outlet of the further heat exchanger preferably opens into the receptacle of the further accumulator vessel, so that after the refrigerating medium has flowed through the further heat exchanger, it can be fed into the further receptacle of the further accumulator vessel. The further heat exchanger can have only one section, which can be flowed through in the second direction, against gravity, i.e. parallel to the flowing-through direction of the second section of the heat exchanger which is arranged in the accumulator vessel. The refrigerating medium outlet of the heat exchanger and the refrigerating medium outlet of the further heat exchanger are preferably arranged at the same height relative to each other. In this way the liquid columns in the receptacle of the accumulator vessel and the receptacle of the further accumulator vessel are kept at the same height, i.e. the fill level of the further accumulator vessel can be kept at the same level as the fill level of the accumulator vessel. This makes optimal exploitation of the storage capacities of the receptacles of the accumulator vessel and of the further accumulator vessel possible.

In an alternative configuration of an accumulator arrangement which is equipped with a further accumulator vessel and a further heat exchanger, a refrigerating medium inlet of the further heat exchanger may be connected to the refrigerating medium outlet of the liquefier. In this way, refrigerating medium liquefied in the liquefier can be fed directly into the further heat exchanger. A refrigerating medium outlet of the further heat exchanger may be connected to the refrigerating medium inlet of the heat exchanger, so that after refrigerating medium has flowed through the further heat exchanger, it can be fed into the heat exchanger. Finally, in such an arrangement, a sump of the accumulator vessel is preferably connected to a sump of the further accumulator vessel, to transfer refrigerating medium which has been received in the receptacle of the accumulator vessel out of the receptacle of the accumulator vessel into the receptacle of the further accumulator vessel. In such an arrangement too, the liquid columns in the accumulator vessel and further accumulator vessel can be kept at the same height.

In a further configuration of an accumulator arrangement which is equipped with a further accumulator vessel and a further heat exchanger, a refrigerating medium inlet of the further heat exchanger may be connected to a further refrigerating medium outlet of the liquefier. Refrigerating medium liquefied in the liquefier can then be fed in parallel into the heat exchanger and further heat exchanger. A refrigerating medium outlet of the further heat exchanger then preferably opens into the receptacle of the further accumulator vessel, the refrigerating medium outlet of the heat exchanger and the refrigerating medium outlet of the further heat exchanger again preferably being arranged at the same height relative to each other, in order to achieve equal fill levels in the receptacle of the accumulator vessel and the receptacle of the further accumulator vessel.

In an accumulator arrangement of this type, the receptacle of the accumulator vessel and the receptacle of the further accumulator vessel may be implemented completely independently of each other, i.e. the receptacle of the accumulator vessel and the receptacle of the further accumulator vessel do not have to be connected to each other. However, alternatively it is also possible to connect a sump of the accumulator vessel to a sump of the further accumulator vessel, in order to transfer refrigerating medium received in the receptacle of the accumulator vessel from the receptacle of the accumulator vessel into the receptacle of the further accumulator vessel. In such an arrangement, only one outlet conduit for discharging refrigerating medium from the receptacles of the accumulator vessel and of the further accumulator vessel is necessary.

In a further configuration of an accumulator arrangement equipped with a further accumulator vessel and a further heat exchanger, a refrigerating medium inlet of the further heat exchanger may be connected to the refrigerating medium outlet of the liquefier, and a refrigerating medium outlet of the further heat exchanger may open into the receptacle of the further accumulator vessel, the refrigerating medium inlet of the heat exchanger being connected to the further heat exchanger upstream from the refrigerating medium outlet of the further heat exchanger. The refrigerating medium outlet of the heat exchanger is preferably arranged above the refrigerating medium outlet of the further heat exchanger. In such an arrangement, refrigerating medium liquefied by the liquefier flows first through the further heat exchanger, and is fed via the refrigerating medium outlet of the further heat exchanger into the receptacle of the further accumulator vessel. After the refrigerating medium has flowed through the further heat exchanger and the heat exchanger, it is fed into the receptacle of the accumulator vessel only when the fill level of the refrigerating medium in the receptacle of the further accumulator vessel has reached a corresponding level. It is thus made possible to fill the receptacle of the further accumulator vessel first, before the receptacle of the accumulator vessel is flooded with refrigerating medium.

The accumulator arrangement may also include a further liquefier, which is adapted to liquefy refrigerating medium to be received in the receptacle of the accumulator vessel and/or the receptacle of the further accumulator vessel before it is fed into the receptacle of the accumulator vessel and/or the receptacle of the further accumulator vessel. The further liquefier also preferably has a refrigerating medium outlet which is connected directly to the receptacle of the accumulator vessel and/or the receptacle of the further accumulator vessel, to discharge refrigerating medium liquefied in the further liquefier from the further liquefier into the receptacle of the accumulator vessel and/or the receptacle of the further accumulator vessel. A further liquefier may be used in an accumulator arrangement with only one accumulator vessel. Also, a further liquefier may be used in an accumulator arrangement which includes an accumulator vessel and a further accumulator vessel.

Since the refrigerating medium outlet of the further liquefier is connected directly to the receptacle of the accumulator vessel and/or the receptacle of the further accumulator vessel, the further liquefier has only the task of liquefying refrigerating medium, and the refrigerating medium which the further liquefier liquefies does not have to be used to subcool the refrigerating medium which has been received in the receptacle of the accumulator vessel and/or the receptacle of the further accumulator vessel. Consequently, the whole power of the further liquefier can be used to liquefy refrigerating medium to be received in the receptacle of the accumulator vessel and/or the receptacle of the further accumulator vessel.

In a configuration of an accumulator arrangement with an accumulator vessel, a further accumulator vessel and a further liquefier, a sump of the accumulator vessel is preferably connected to a sump of the further accumulator vessel, to make it possible to transfer refrigerating medium from the receptacle of the accumulator vessel into the receptacle of the further accumulator vessel.

The receptacle of the accumulator vessel and/or the receptacle of the further accumulator vessel may be connected via a vent pipe to an interior of the liquefier. Additionally or alternatively, the receptacle of the accumulator vessel and/or the receptacle of the further accumulator vessel may be connected via a recirculation conduit to an interior of the liquefier. Via the recirculation conduit, refrigerating medium can be recirculated from the receptacle of the accumulator vessel and/or the receptacle of the further accumulator vessel into the interior of the liquefier, where the refrigerating medium can be recooled.

In a further embodiment of the accumulator arrangement according to the invention, the heat exchanger may have, upstream from its refrigerating medium outlet, an opening, or multiple openings which open(s) into the receptacle of the accumulator vessel at different heights. Alternatively or additionally, the further heat exchanger may have, upstream from its refrigerating medium outlet, an opening, or multiple openings which open(s) into the receptacle of the further accumulator vessel at different heights. Through the openings which are formed in the heat exchanger and/or the further heat exchanger, refrigerating medium can flow from the heat exchanger and/or the further heat exchanger into the receptacle of the accumulator vessel and/or the receptacle of the further accumulator vessel.

In an accumulator arrangement which is executed in this form, the refrigerating medium flows first through the lowest openings in the heat exchanger and/or further heat exchanger into the receptacle of the accumulator vessel and/or the receptacle of the further accumulator vessel. Thus the fill level in the receptacle of the accumulator vessel and/or the receptacle of the further accumulator vessel rises, whereas the fill level in the liquefier does not rise. Consequently, in the liquefier, the refrigerating medium received in the interior of the liquefier is not subcooled, i.e. the power of the liquefier can be used exclusively to liquefy the refrigerating medium in the liquefier.

If refrigerating medium continues to be fed into the heat exchanger and/or the further heat exchanger, the fill level in the receptacle of the accumulator vessel and/or the receptacle of the further accumulator vessel rises until lower openings of the heat exchanger and/or further heat exchanger are flooded, but higher openings of the heat exchanger and/or further heat exchanger are still free. Refrigerating medium which flows through the heat exchanger and/or further heat exchanger then continues to be fed exclusively through the openings in the heat exchanger and/or further heat exchanger, but not through the refrigerating medium outlet of the heat exchanger and/or further heat exchanger, into the receptacle of the accumulator vessel and/or the receptacle of the further accumulator vessel. In this operating phase of the accumulator arrangement, the fill level in the liquefier rises, but it is still below the height of the refrigerating medium outlet of the heat exchanger and/or of the further heat exchanger. In the liquefier, subcooling of the refrigerating medium which has been received in the interior of the liquefier now takes place, so that the liquefying power of the liquefier decreases slightly.

If the fill level in the receptacle of the accumulator vessel and/or the receptacle of the further accumulator vessel is so high that all or almost all the openings which are formed in the heat exchanger and/or further heat exchanger are flooded, the refrigerating medium escapes from the heat exchanger and/or further heat exchanger via the refrigerating medium outlet of the heat exchanger and/or further heat exchanger. The fill level in the liquefier and the fill level in the receptacle of the accumulator vessel and/or the receptacle of the further accumulator vessel now rise until they have reached the same level. The higher the fill level in the liquefier, the greater is the subcooling power of the liquefier.

The accumulator arrangement may further comprise a first separation sheet which is arranged in the liquefier so as to separate a first area of the liquefier from a second area of the liquefier. Preferably, the second area of the liquefier is arranged above the first area of the liquefier, i.e. preferably, the first separation sheet is arranged in the liquefier such that the first separation sheet forms a substantially horizontal separation between the first and the second area of the liquefier. The first separation sheet serves to separate a subcooled area of the liquefier, i.e. an area of the liquefier which contains subcooled refrigerating medium, from the phase boundary between liquid refrigerating medium and vaporous refrigerating medium. In other words, during operation of the liquefier, the first separation sheet preferably is arranged in the liquefier so as to extend below the surface of the liquid refrigerating medium in the liquefier. By separating the subcooled refrigerating medium from the phase boundary between liquid refrigerating medium and vaporous refrigerating medium in the liquefier, subcooling of the refrigerating medium in the liquefier is enhanced.

The accumulator arrangement may further comprise a second separation sheet which is arranged in the receptacle of the accumulator vessel so as to separate a first area of the receptacle from a second area of the receptacle. Preferably, the second area of the receptacle is arranged above the first area of the receptacle, i.e. preferably, the second separation sheet is arranged in the receptacle of the accumulator vessel such that the second separation sheet forms a substantially horizontal separation between the first and the second area of the receptacle. The second separation sheet serves to separate a subcooled area of the receptacle, i.e. an area of the receptacle of the accumulator vessel which contains subcooled refrigerating medium, from the phase boundary between liquid refrigerating medium and vaporous refrigerating medium. In other words, during operation of the accumulator vessel, the second separation sheet preferably is arranged in the receptacle of the accumulator vessel so as to extend below the surface of the liquid refrigerating medium in the receptacle of the accumulator vessel. By separating the subcooled refrigerating medium from the phase boundary between liquid refrigerating medium and vaporous refrigerating medium in the liquefier, subcooling of the refrigerating medium in the accumulator vessel is enhanced.

The first separation sheet may be provided with at least one opening. Preferably, a plurality of openings is formed in the first separation sheet. For example, the first separation sheet may be designed in the form of a perforated plate of foil. A first separation sheet including at least one opening still provides for an effective separation of the subcooled refrigerating medium in the liquefier from the phase boundary between liquid refrigerating medium and vaporous refrigerating medium, but allows a flow of liquid refrigerating medium between the first and the second area of the liquefier. Hence, if necessary, pressure equalization between the first and the second area of the liquefier may take place.

Similarly, the second separation sheet may also be provided with at least one opening. Preferably, a plurality of openings is formed in the second separation sheet. For example, the second separation sheet may be designed in the form of a perforated plate of foil. A second separation sheet including at least one opening still provides for an effective separation of the subcooled refrigerating medium in the receptacle of the accumulator vessel from the phase boundary between liquid refrigerating medium and vaporous refrigerating medium, but allows a flow of liquid refrigerating medium between the first and the second area of the receptacle. Hence, if necessary, pressure equalization between the first and the second area of the receptacle may take place.

In a method according to the invention for operating an accumulator arrangement which is suitable, in particular, for use in a cooling system which is designed for operation with a two-phase refrigerating medium, refrigerating medium which is to be received in a receptacle of an accumulator vessel is liquefied in a liquefier. The refrigerating medium which has been liquefied in the liquefier is fed through a refrigerating medium outlet of the liquefier into a heat exchanger which is arranged in the receptacle of the accumulator vessel. Finally, the refrigerating medium is discharged from the heat exchanger into the receptacle of the accumulator vessel through a refrigerating medium outlet of the heat exchanger.

The refrigerating medium liquefied in the liquefier may be fed out of the liquefier into the heat exchanger through a refrigerating medium outlet of the liquefier, said refrigerating medium outlet being arranged in the region of a sump of the liquefier. Alternatively or additionally, the refrigerating medium liquefied in the liquefier may be fed out of the liquefier into the heat exchanger through a refrigerating medium outlet of the liquefier, said refrigerating medium outlet being arranged at the same height as a refrigerating medium inlet of the heat exchanger. It is also possible to discharge the refrigerating medium through a refrigerating medium outlet of the heat exchanger from the heat exchanger into the receptacle of the accumulator vessel, which is arranged above the refrigerating medium outlet of the liquefier.

The heat exchanger may comprise a first section and a second section which is arranged downstream from the first section. Refrigerating medium which is fed from the refrigerating medium outlet of the liquefier into the heat exchanger may flow through the first section of the heat exchanger in a first direction, driven by gravity. In contrast, refrigerating medium may flow through the second section of the heat exchanger in a second direction opposite to the first direction.

An accumulator arrangement which includes a further accumulator vessel with a receptacle to receive a refrigerating medium and a further heat exchanger which is arranged in the receptacle of the further accumulator vessel may be operated as follows:

In a first embodiment of the operating method according to the invention, refrigerating medium may be fed from a sump of the accumulator vessel into the further heat exchanger. Refrigerating medium may also be discharged from the further heat exchanger into the receptacle of the further accumulator vessel.

Alternatively, refrigerating medium liquefied in the liquefier may be fed into the further heat exchanger, the refrigerating medium may be discharged from the further heat exchanger into the heat exchanger, and finally refrigerating medium may be fed from the sump of the accumulator vessel into the sump of the further accumulator vessel.

It is also conceivable to feed refrigerating medium liquefied in the liquefier into the further heat exchanger, and to discharge the refrigerating medium from the further heat exchanger into the receptacle of the further accumulator vessel, in which case, in particular, refrigerating medium may be transferred from the sump of the accumulator vessel into the sump of the further accumulator vessel.

Finally, it is possible to feed refrigerating medium liquefied in the liquefier into the further heat exchanger, and to discharge the refrigerating medium from the further heat exchanger into the receptacle of the further accumulator vessel, in which case refrigerating medium may be fed from the further heat exchanger into the heat exchanger upstream from a refrigerating medium outlet of the further heat exchanger.

Refrigerating medium to be received in the receptacle of the accumulator vessel and/or the receptacle of the further accumulator vessel may be liquefied by a further liquefier, in which case the refrigerating medium liquefied by the further liquefier may be fed directly into the receptacle of the accumulator vessel and/or the receptacle of the further accumulator vessel.

The receptacle of the accumulator vessel and/or the receptacle of the further accumulator vessel may be vented via a vent pipe which is connected to an interior of the liquefier. Alternatively or additionally, refrigerating medium may be recirculated from the receptacle of the accumulator vessel and/or the receptacle of the further accumulator vessel into the interior of the liquefier, via a recirculation conduit which is connected to the interior of the liquefier.

Refrigerating medium may be fed from the heat exchanger into the receptacle of the accumulator vessel through multiple openings of the heat exchanger, said openings opening at different heights into the receptacle of the accumulator vessel upstream from a refrigerating medium outlet of the heat exchanger. Additionally or alternatively, refrigerating medium may be fed from the further heat exchanger into the receptacle of the further accumulator vessel through multiple openings of the further heat exchanger, said openings opening at different heights into the receptacle of the further accumulator vessel upstream from a refrigerating medium outlet of the further heat exchanger.

BRIEF DESCRIPTION OF THE DRAWINGS

Preferred embodiments of the invention are now explained in more detail on the basis of the attached schematic drawings, of which

DETAILED DESCRIPTION

Figure 1:
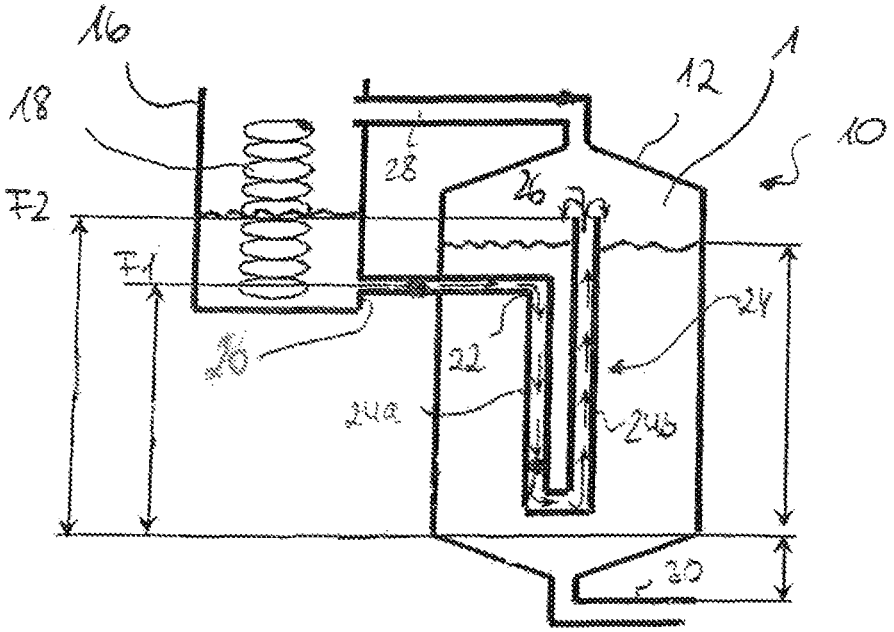
FIG. 1 shows a first embodiment of an accumulator arrangement suitable for use in a cooling system which is designed for operation with a two-phase refrigerating medium.

A first embodiment, shown in FIG. 1, of an accumulator arrangement 10 suitable, in particular, for use in a cooling system which is designed for operation with a two-phase refrigerating medium, includes an accumulator vessel 12, in the interior of which a receptacle 14 for receiving a refrigerating medium is arranged. The refrigerating medium to be received in the receptacle 14 of the accumulator vessel 12 is a two-phase refrigerating medium, e.g. $CO_2$ or R134A. In operation of the accumulator arrangement 10, the refrigerating medium which is received in the receptacle 14 of the accumulator vessel 12 is usually present in the form of a boiling liquid. The receptacle 14, i.e. a jacket which surrounds the receptacle 14, must therefore be designed so that it can resist the pressure of the refrigerating medium which is received in the receptacle 14 in the form of a boiling liquid without being damaged.

The accumulator arrangement 10 also includes a liquefier 16, which is formed separate from the accumulator vessel 12, and is used to convert refrigerating medium to be received into the receptacle 14 of the accumulator vessel 12 from its gaseous state of aggregation to its liquid state of aggregation. In an interior of the liquefier 16, a heat exchanger 18 is arranged. A further refrigerating medium flows through the heat exchanger 18, and is cooled to a desired low temperature by an external cold-generating device (not shown in the figures). The further refrigerating medium which is fed through the heat exchanger 18 of the liquefier 16 may be a liquid refrigerating medium, but also a two-phase refrigerating medium.

The liquefier 16 has a refrigerating medium outlet 20 which is arranged in the region of a sump of the liquefier 16, for discharging refrigerating medium liquefied in the liquefier 16 from the liquefier 16. Since the refrigerating medium outlet 20 is arranged in the region of a sump of the liquefier 16, refrigerating medium liquefied in the liquefier 16 can be discharged from the liquefier 16 driven by gravity. The refrigerating medium outlet 20 of the liquefier 16 is connected to a refrigerating medium inlet 22 of a heat exchanger 24, said inlet 22 being arranged at the same height relative to the refrigerating medium outlet 20 of the liquefier 16, and said heat exchanger 24 being arranged in the receptacle 14 of the accumulator vessel 12. Consequently, the refrigerating medium liquefied in the liquefier 16 can be conveyed without problems to the refrigerating medium inlet 22 of the heat exchanger 24 by the gravitational force of the refrigerating medium liquid column in the liquefier 16.

The heat exchanger 24 comprises a first section 24*a* and a second section 24*b* which is arranged downstream from the first section 24*a*. The first section 24*a* of the heat exchanger 24 is arranged below the refrigerating medium outlet 20 of the liquefier 16, and below the refrigerating medium inlet 22 of the heat exchanger 24, so that refrigerating medium which is fed from the refrigerating medium outlet 20 of the liquefier 16 into the heat exchanger 24 can flow through the first section 24*a* in a first direction, driven by gravity, i.e. downward in FIG. 1. The second section 24*b* of the heat exchanger 24 is positioned relative to the first section 24*a* of the heat exchanger 24 so that refrigerating medium can flow through it in a second direction opposite to the first direction, i.e. upward in FIG. 1. Consequently, refrigerating medium is conveyed from the first section 24*a* of the heat exchanger 24 into the second section 24*b* of the heat exchanger only if the liquid column in the liquefier 16 provides sufficient gravitational force to convey the refrigerating medium from the first section 24*a* of the heat exchanger 24 into the second section 24*b* of the heat exchanger.

The heat exchanger 24, or the second section 24*b* of the heat exchanger 24, has a refrigerating medium outlet 26 which opens into the receptacle 14 of the accumulator vessel 12, to carry refrigerating medium out of the heat exchanger 24 into the receptacle 14 of the accumulator vessel 12. The refrigerating medium outlet 26 of the heat exchanger 24 is arranged above the refrigerating medium outlet 20 of the liquefier 16 and above the refrigerating medium inlet 22 of the heat exchanger 24. In an upper region, the accumulator vessel 12 is connected via a vent pipe 28 to an interior of the liquefier 16. Additionally, a refrigerating medium removal conduit 30 which is connected to a sump of the accumulator vessel 12, and via which refrigerating medium which has been stored temporarily in the receptacle 14 of the accumulator vessel 12 can be removed from the accumulator vessel 12 and introduced into a cooling circuit of a cooling system equipped with the accumulator arrangement 10, is provided. It is understood that if required, in the refrigerating medium removal conduit 30, the vent pipe 28 and/or a conduit system of the liquefier 16 and/or of the heat exchanger 24, corresponding valves to control the flow of the refrigerating medium through these components of the accumulator arrangement 10 may be arranged. Additionally, in the refrigerating medium removal conduit 30, a conveying device, e.g. implemented in the form of a pump, may be arranged.

Below, the operation of the accumulator arrangement 10 is explained. At the start of operation of the system, refrigerating medium, which at first is present in the gaseous state of aggregation, is fed to the liquefier 16. By heat transfer to the further refrigerating medium which flows through the heat exchanger 18 of the liquefier 16, the gaseous heat transfer medium in the liquefier is cooled and converted into its liquid state of aggregation. When the liquid refrigerating medium in the liquefier 16 has reached a fill level F1, the refrigerating medium flows through the refrigerating medium outlet 20 of the liquefier 16 in the direction of the refrigerating medium inlet 22 of the heat exchanger 24. After entering the refrigerating medium inlet 22 of the heat exchanger 24, the refrigerating medium flows through the first section 24*a* of the heat exchanger 24 driven by gravity, and then rises into the second section 24*b* of the heat exchanger 24 as far as the fill level F1. Since the refrigerating medium outlet 26 of the heat exchanger 24 is above the fill level height F1, in this operating phase of the accumulator arrangement 10 no refrigerating medium yet escapes from the heat exchanger 24 into the receptacle 14 of the accumulator vessel 12.

In further operation of the liquefier 16, the fill level of the liquid refrigerating medium in the liquefier 16 rises. Part of the cooling energy of the further refrigerating medium which flows through the heat exchanger 18 of the liquefier 16 is then used to subcool the liquid refrigerating medium in the liquefier 16. The liquefying power of the liquefier 16 thus falls. When the fill level of the liquid refrigerating medium in the liquefier 16 has reached a level F2, refrigerating medium escapes from the heat exchanger 24 via the refrigerating medium outlet 26 of the heat exchanger 24, and flows into the receptacle 14 of the accumulator vessel 12. The refrigerating medium which is received in the receptacle 14 of the accumulator vessel 12 is continuously subcooled, since the refrigerating medium forms a thermal bridge between the heat exchanger 18 of the liquefier 16 and the heat exchanger 24 in the receptacle 14.

If required, the receptacle 14 of the accumulator vessel 12 can be vented via the vent pipe 28 into the interior of the liquefier 16. Finally, via the refrigerating medium removal conduit 30, refrigerating medium which has been stored temporarily in the receptacle 14 of the accumulator vessel 12 can be carried out of the accumulator vessel 12 and fed to a cooling circuit of a cooling system which is equipped with the accumulator arrangement 10. The accumulator arrangement 10 ensures that the refrigerating medium is always fed in a liquid, subcooled state to a conveying device, to convey the refrigerating medium from the receptacle of the accumulator vessel 12.

Figure 2:
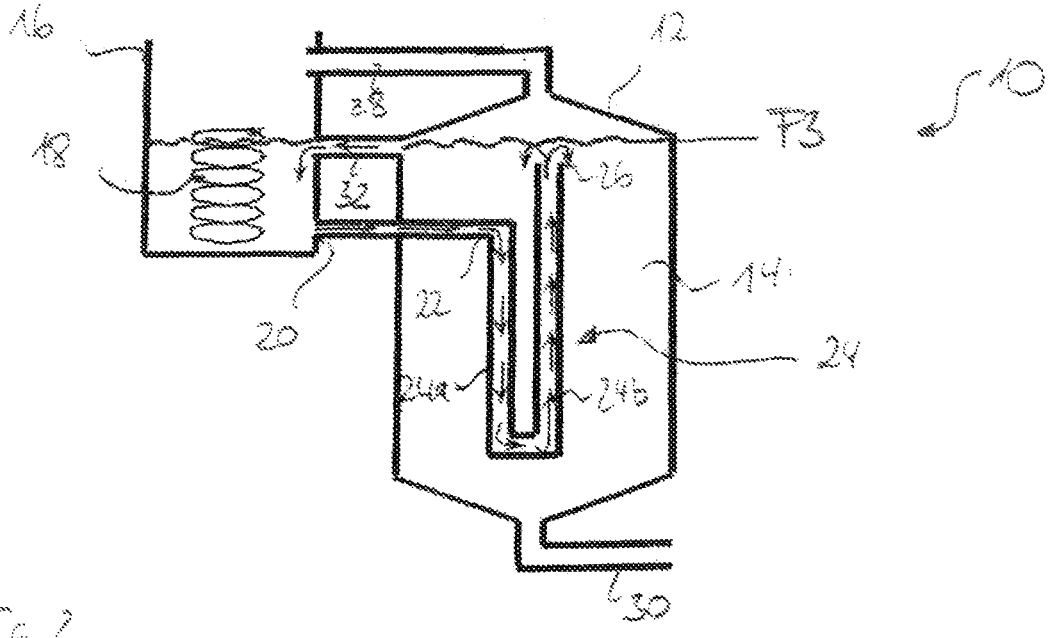
FIG. 2 shows a second embodiment of an accumulator arrangement suitable for use in a cooling system which is designed for operation with a two-phase refrigerating medium.

A second embodiment of an accumulator arrangement 10, shown in FIG. 2, differs from the system according to FIG. 1 only in that the receptacle 14 of the accumulator vessel 12 is connected via a recirculation conduit 32 to the interior of the liquefier 16. The recirculation conduit 32 branches away from the receptacle 14 of the accumulator vessel 12 above the refrigerating medium outlet 26 of the heat exchanger 24, so that in operation of the accumulator arrangement 10 refrigerating medium can be recirculated from the receptacle 14 of the accumulator vessel 12 in the interior of the liquefier 16 only if the fill level of the refrigerating medium in the receptacle 14 of the accumulator vessel 12 has reached a level F3.

The refrigerating medium which has been recirculated from the receptacle 14 of the accumulator vessel 12 into the interior of the liquefier 16 is subcooled again in the liquefier 16. Such a configuration of the accumulator arrangement ensures that refrigerating medium which, because of the fill level height of the refrigerating medium in the receptacle 14 of the accumulator vessel 12, is no longer in thermal contact with the heat exchanger 24 can be recirculated and further subcooled in the interior of the liquefier 16. Otherwise, the structure and mode of operation of the accumulator arrangement 10 shown in FIG. 2 correspond to the structure and mode of operation of the arrangement according to FIG. 1.

Figure 3:
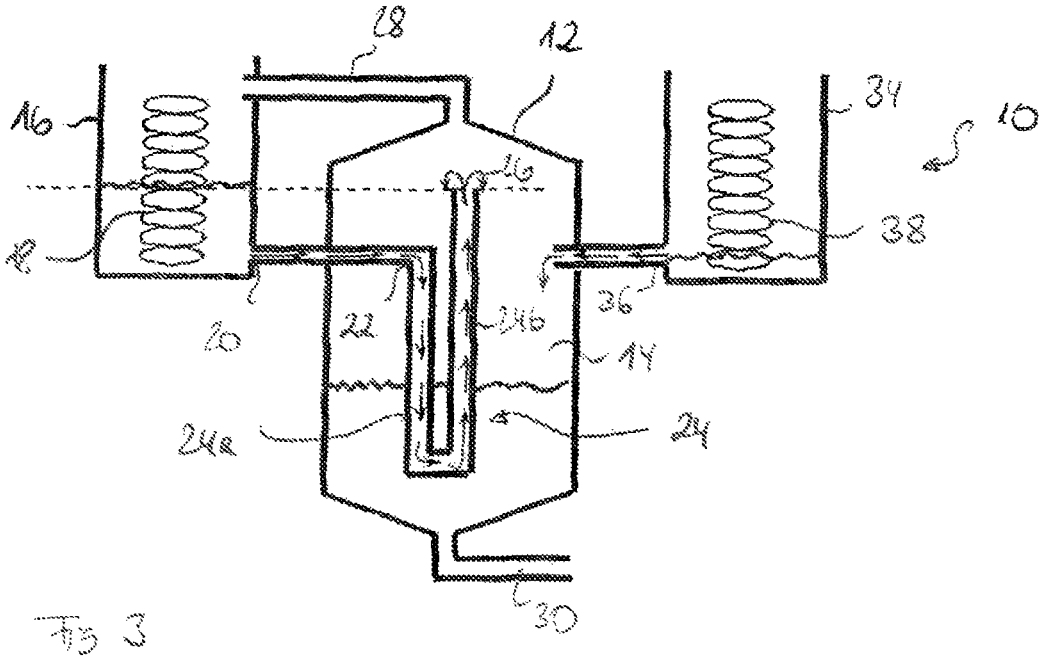
FIG. 3 shows a third embodiment of an accumulator arrangement suitable for use in a cooling system which is designed for operation with a two-phase refrigerating medium.

A third embodiment of an accumulator arrangement 10, shown in FIG. 3, differs from the system according to FIG. 1 by a further liquefier 34, which is adapted to liquefy refrigerating medium to be received in the receptacle 14 of the accumulator vessel 12. The further liquefier 34 has a refrigerating medium outlet 36, which is connected directly to the receptacle 14 of the accumulator vessel 12. A heat exchanger 38 of the further liquefier 34 is used exclusively to make cooling energy available to liquefy the refrigerating medium in the further liquefier 34. The refrigerating medium in the further liquefier 38 is not subcooled. Thus the further liquefier 34 ensures that sufficient liquefying power is always available to the accumulator arrangement 10. Otherwise, the structure and mode of operation of the accumulator arrangement 10 shown in FIG. 3 correspond to the structure and mode of operation of the system according to FIG. 1.

Figure 4:
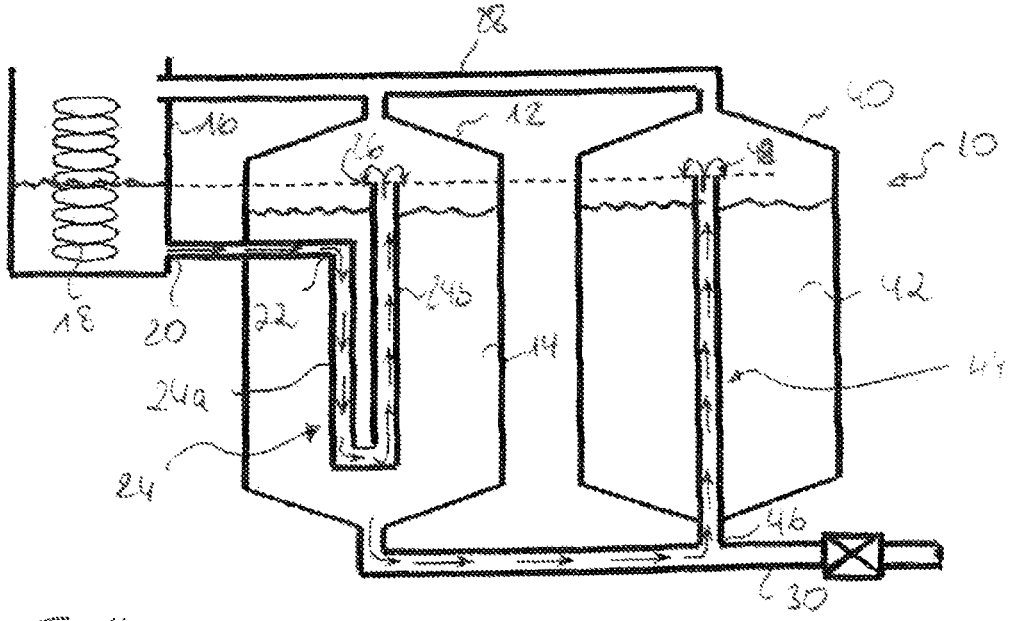
FIG. 4 shows a fourth embodiment of an accumulator arrangement suitable for use in a cooling system which is designed for operation with a two-phase refrigerating medium.

A fourth embodiment of an accumulator arrangement 10, shown in FIG. 4, differs from the system according to FIG. 1 by a further accumulator vessel 40 with a receptacle 42 to receive a refrigerating medium, and a further heat exchanger 44 which is arranged in the receptacle 42 of the further accumulator vessel 40. A refrigerating medium inlet 46 of the further heat exchanger is connected to a sump of the accumulator vessel 12. In contrast, a refrigerating medium outlet 48 of the further heat exchanger 44 opens into the receptacle 42 of the further accumulator vessel 40, the refrigerating medium outlet 26 of the heat exchanger 24 and the refrigerating medium outlet 48 of the further heat exchanger 44 being arranged at the same height relative to each other. In operation of the accumulator arrangement 10, refrigerating medium which has been liquefied in the liquefier 16 is fed first through the heat exchanger 24 and then into the receptacle 14 of the accumulator vessel 12. The refrigerating medium is then transferred from the sump of the accumulator vessel 12 into the receptacle 42 of the further accumulator vessel 40 via the further heat exchanger 44.

The arrangement of the refrigerating medium outlets 26, 48 of the heat exchanger 24 and further heat exchanger 44 ensures that the receptacles 14, 42 of the accumulator vessel 12 and further accumulator vessel 14 are filled evenly with refrigerating medium. Refrigerating medium is carried away from the receptacles 14, 42 of the accumulator vessel 12 and further accumulator vessel 40 via a common refrigerating medium removal conduit 30. Additionally, the receptacles 14, 42 of the accumulator vessel 12 and further accumulator vessel 40 are connected via a common vent pipe 28 to the interior of the liquefier 16. Otherwise, the structure and mode of operation of the accumulator arrangement 10 shown in FIG. 4 correspond to the structure and mode of operation of the system according to FIG. 1.

Figure 5:
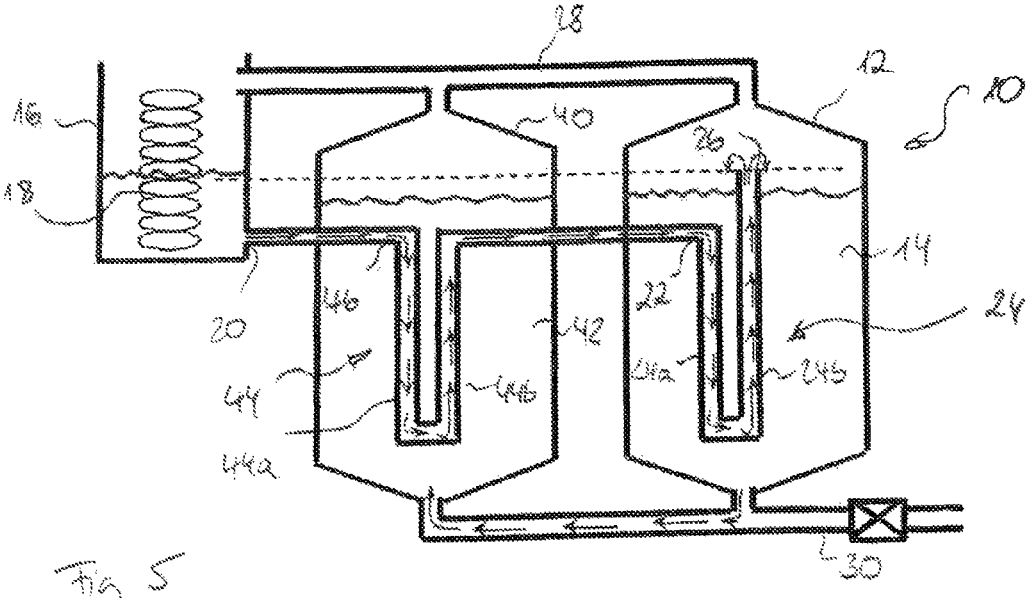
FIG. 5 shows a fifth embodiment of an accumulator arrangement suitable for use in a cooling system which is designed for operation with a two-phase refrigerating medium.

A fifth embodiment of an accumulator arrangement 10, shown in FIG. 5, differs from the system according to FIG. 4 in that now the further accumulator vessel 40 is connected between the liquefier 16 and the accumulator vessel 12. The refrigerating medium inlet 46 of the further heat exchanger 44 is now connected to the refrigerating medium outlet 20 of the liquefier 16. In contrast, the refrigerating medium outlet 48 of the further heat exchanger 44 is connected to the refrigerating medium inlet 22 of the heat exchanger 24. Consequently, refrigerating medium liquefied in the liquefier 16 is fed first through the further heat exchanger 44, before it is fed into the receptacle 14 of the accumulator vessel 12 after flowing through the heat exchanger 24. The further heat exchanger 44 now has a first section 44*a* through which refrigerating medium can flow in the first direction, i.e. downward in FIG. 5, and a second section 44*b*, through which it can flow in a second direction, opposite to the first direction, i.e. upward in FIG. 5. The sump of the accumulator vessel 12 is connected to the sump of the further accumulator vessel 44, to transfer refrigerating medium which has been received in the receptacle 14 of the accumulator vessel 12 into the receptacle 42 of the further accumulator vessel. Otherwise, the structure and mode of operation of the accumulator arrangement 10 shown in FIG. 5 correspond to the structure and mode of operation of the system according to FIG. 4.

Figure 6:
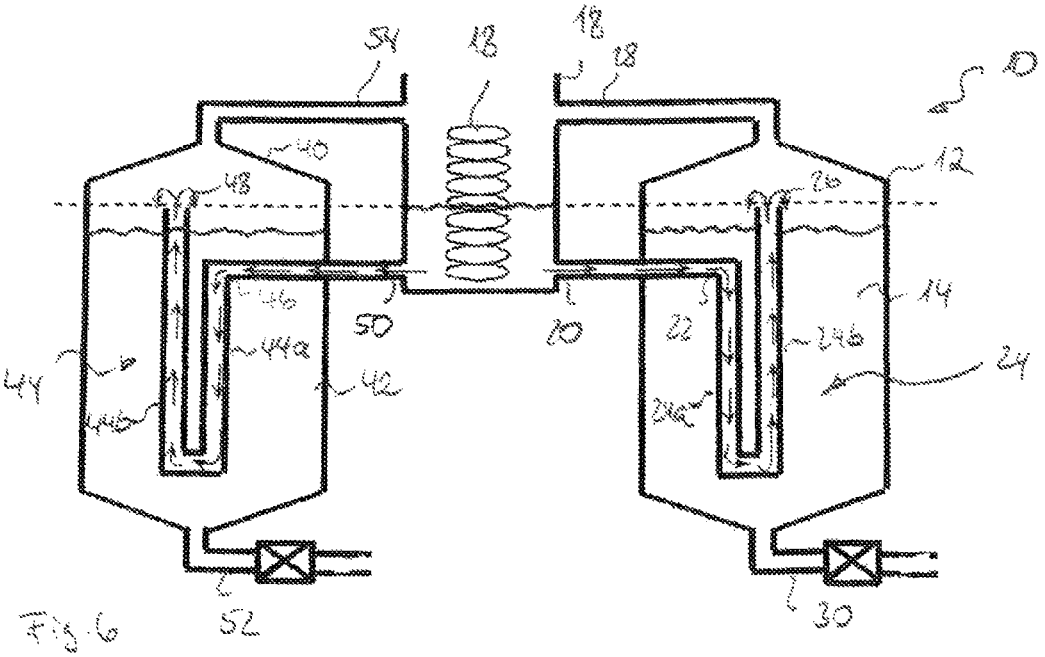
FIG. 6 shows a sixth embodiment of an accumulator arrangement suitable for use in a cooling system which is designed for operation with a two-phase refrigerating medium.

A sixth embodiment of an accumulator arrangement 10, shown in FIG. 6, differs from the system according to FIG. 5 in that the liquefier 16 is now connected between the further accumulator vessel 40 and the accumulator vessel 12. The refrigerating medium inlet 46 of the further heat exchanger 44 is connected to a further refrigerating medium outlet 50 of the liquefier 16. To ensure that refrigerating medium liquefied in the liquefier 16 is fed equally into the receptacle 14 of the accumulator vessel 12 and the receptacle 42 of the further accumulator vessel 40, the refrigerating medium outlet 20, the further refrigerating medium outlet of the liquefier 16 and the refrigerating medium inlets 22, 46 of the heat exchanger 24 and further heat exchanger 44 are arranged at the same height relative to each other. Also, not only refrigerating medium which is fed from the liquefier 16 into the heat exchanger 24 flows through the further heat exchanger 44.

Instead, a refrigerating medium outlet 48 of the further heat exchanger 44 opens into the receptacle 42 of the accumulator vessel 40, so that after refrigerating medium has flowed through the further heat exchanger 44 it can be fed into the receptacle 42 of the further accumulator vessel 40. Refrigerating medium is carried away from the receptacle 42 of the further accumulator vessel 40 via a further refrigerating medium removal conduit 52, which is in a separate form from the refrigerating medium removal conduit 30 of the accumulator vessel 12. Finally, there is a further vent pipe 54, which is formed separate from the vent pipe 28 of the accumulator vessel 12, and via which venting the receptacle 42 of the further accumulator vessel 40 into the interior of the liquefier 16 is possible. Otherwise, the structure and mode of operation of the accumulator arrangement 10 shown in FIG. 6 correspond to the structure and mode of operation of the system according to FIG. 5.

Figure 7:
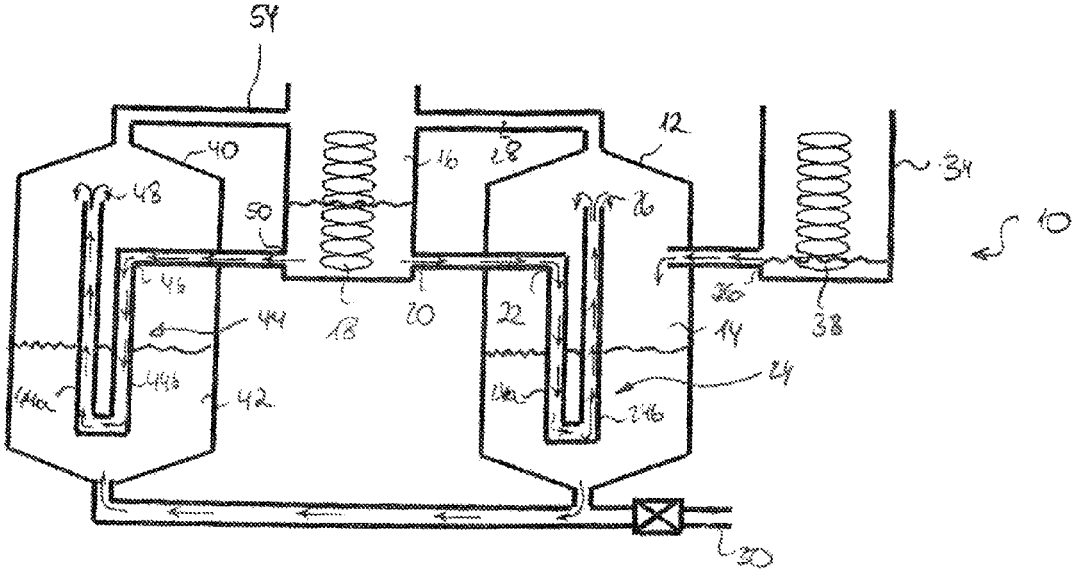
FIG. 7 shows a seventh embodiment of an accumulator arrangement suitable for use in a cooling system which is designed for operation with a two-phase refrigerating medium.

A seventh embodiment of an accumulator arrangement 10, shown in FIG. 7, differs from the system according to FIG. 6 in that the accumulator arrangement 10 includes a further liquefier 34, the refrigerating medium outlet 36 of which opens directly into the receptacle 14 of the accumulator vessel 12. Additionally, the sump of the accumulator vessel 12 is connected to the sump of the further accumulator vessel 40, so that refrigerating medium can be transferred from the receptacle 14 of the accumulator vessel into the receptacle 42 of the further accumulator vessel 40. Refrigerating medium is carried away from the receptacles 12, 42 of the accumulator vessel 12 and further accumulator vessel 40 via a common refrigerating medium removal conduit 30. Otherwise, the structure and mode of operation of the accumulator arrangement 10 shown in FIG. 7 correspond to the structure and mode of operation of the system according to FIG. 6.

Figure 8:
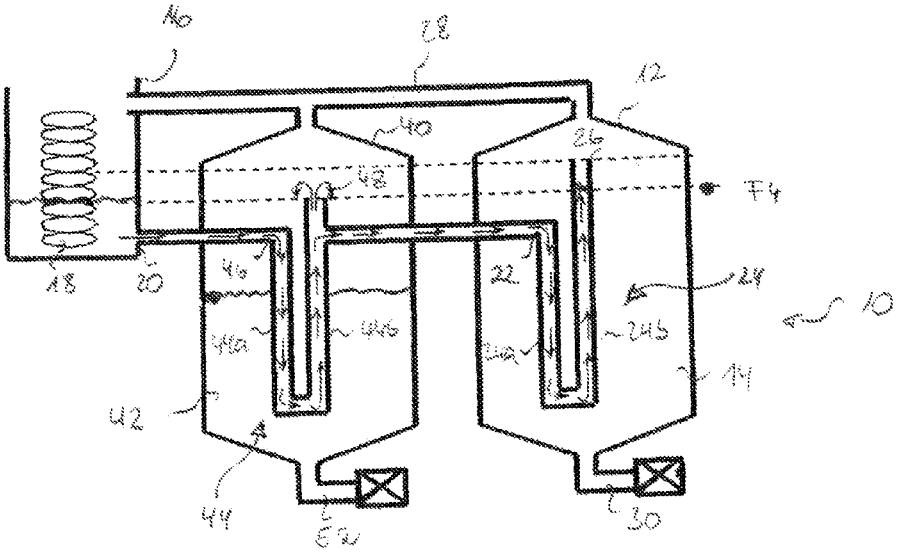
FIG. 8 shows an eighth embodiment of an accumulator arrangement suitable for use in a cooling system which is designed for operation with a two-phase refrigerating medium.

An eighth embodiment of an accumulator arrangement 10, shown in FIG. 8, differs from the system shown in FIG. 5 in that the further heat exchanger 44 is not only flowed through by the refrigerating medium which has been liquefied in the liquefier 16 and fed to the heat exchanger 24, but itself includes a refrigerating medium outlet 48 which opens into the receptacle 42 of the further accumulator vessel 40. Via the refrigerating medium outlet 48 of the further heat exchanger 44, refrigerating medium liquefied in the liquefier 16 can be fed into the receptacle 42 of the further accumulator vessel 40 after it has flowed through the further heat exchanger 44. The refrigerating medium inlet 22 of the heat exchanger 24 is connected to the further heat exchanger 44 upstream from the refrigerating medium outlet 48 of the further heat exchanger 44.

The refrigerating medium outlet 26 of the heat exchanger 24 is arranged above the refrigerating medium outlet 48 of the further heat exchanger 44. The result is that refrigerating medium liquefied in the liquefier 16 is fed first via the refrigerating medium outlet 48 of the further heat exchanger 44 into the receptacle 42 of the further accumulator vessel 40, until the refrigerating medium in the receptacle 42 of the further accumulator vessel 40 has reached a fill level F4 at the height of the refrigerating medium outlet 48 of the further heat exchanger 44. Only then, the refrigerating medium is also fed via the refrigerating medium outlet 26 of the heat exchanger 24 into the receptacle 14 of the accumulator vessel 12. Refrigerating medium is discharged from the receptacle 14 of the accumulator vessel 12 via a refrigerating medium removal conduit 30, and refrigerating medium is discharged from the receptacle 42 of the further accumulator vessel 40 via a further refrigerating medium removal conduit 52, which is formed separate from the refrigerating medium removal conduit 30. Otherwise, the structure and mode of operation of the accumulator arrangement 10 according to FIG. 8 correspond to the structure and mode of operation of the arrangement shown in FIG. 5.

Figure 9A:
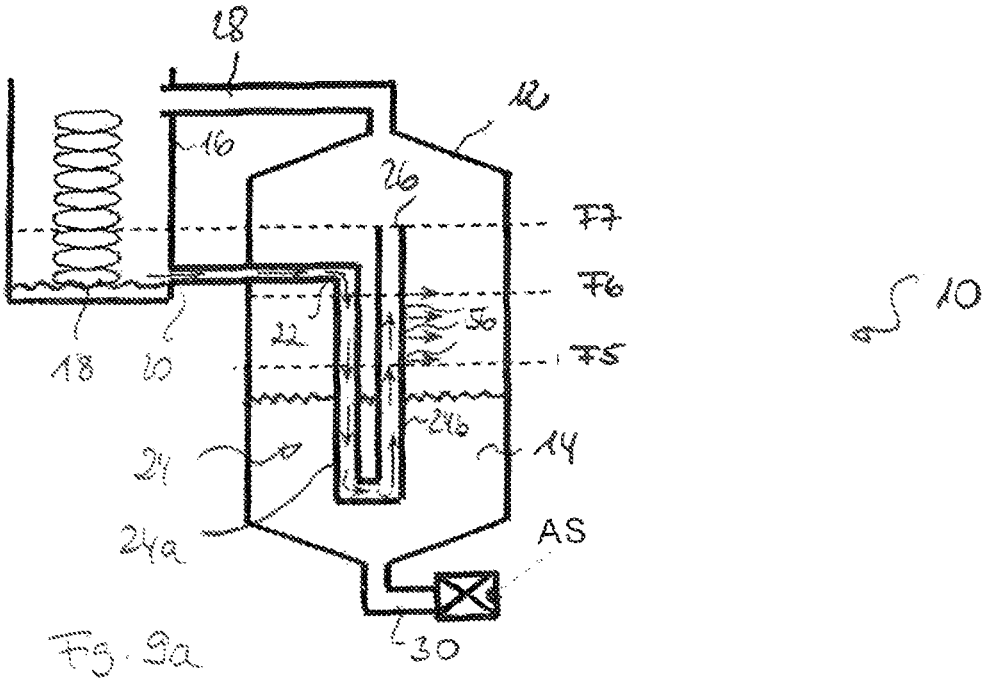
FIGS. 9*a* to 9*c* show the operation of a ninth embodiment of an accumulator arrangement suitable for use in a cooling system which is designed for operation with a two-phase refrigerating medium.
Figure 9B:
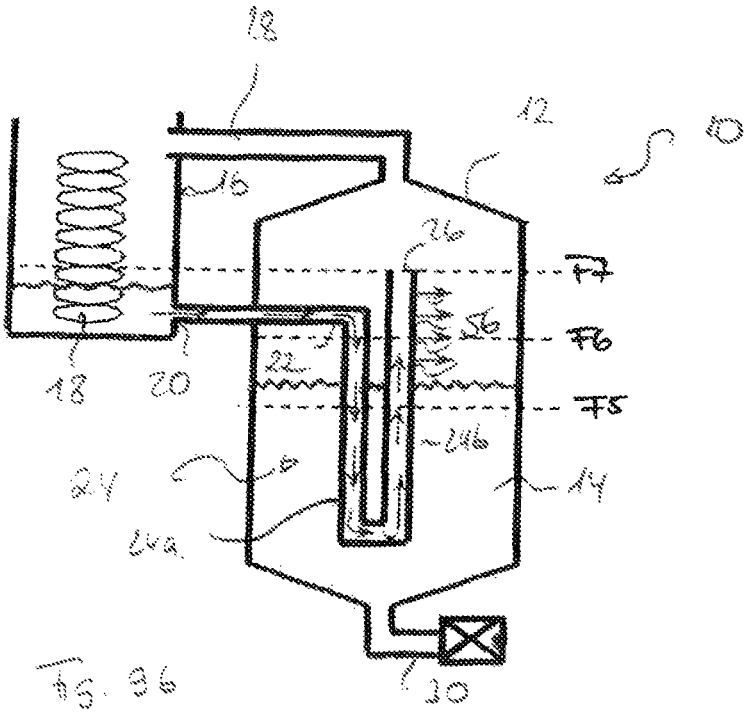
Figure 9C:
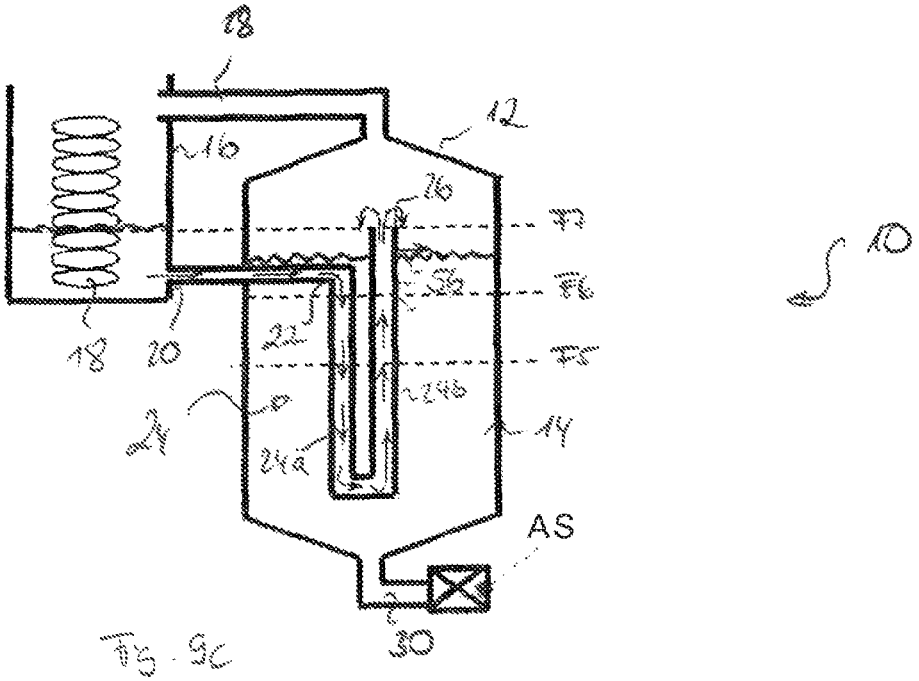

Finally, in FIGS. 9*a* to 9*c*, the mode of operation of a ninth embodiment of an accumulator arrangement 10 is illustrated, and differs from the system according to FIG. 1 in that the heat exchanger 24 has, upstream from its refrigerating medium outlet 26, multiple openings 56 which open into the receptacle 14 of the accumulator vessel 12 at different heights. As shown in FIG. 9*a*, refrigerating medium which has been liquefied in the liquefier 16 first escapes through lower openings 56 from the heat exchanger 24 into the receptacle 14 of the accumulator vessel 12, so that the fill level of the refrigerating medium in the liquefier 16 remains at the height of the refrigerating medium outlet 20 of the liquefier 16 and does not rise further. In this way, all the cooling energy which the heat exchanger 18 of the liquefier 16 provides can be used to liquefy refrigerating medium which is received in the liquefier 16 or fed to the liquefier 16.

Only when the fill level of the refrigerating medium in the receptacle 14 of the accumulator vessel 12 rises from a level F5 to a level F6, at which some of the openings 56 of the heat exchanger 24 are flooded, the fill level in the liquefier 16 rises, see FIG. 9*b*. While reducing its liquefier power, the liquefier 16 now ensures subcooling of the refrigerating medium received in the liquefier 16. When the fill level of the refrigerating medium in the receptacle 14 of the accumulator vessel 12 has reached a level at which few or no openings 56 of the heat exchanger 24 are still free, the refrigerating medium which has been fed from the liquefier 16 into the heat exchanger 24 also enters the receptacle 14 of the accumulator vessel 12 via the refrigerating medium outlet 26 of the heat exchanger 24, see FIG. 9*c*. The level of the fill level in the liquefier 16 in this operating phase is F7. Otherwise, the structure and mode of operation of the accumulator arrangement 10 according to FIGS. 9*a* to 9*c* correspond to the structure and mode of operation of the arrangement shown in FIG. 1.

Figure 10:
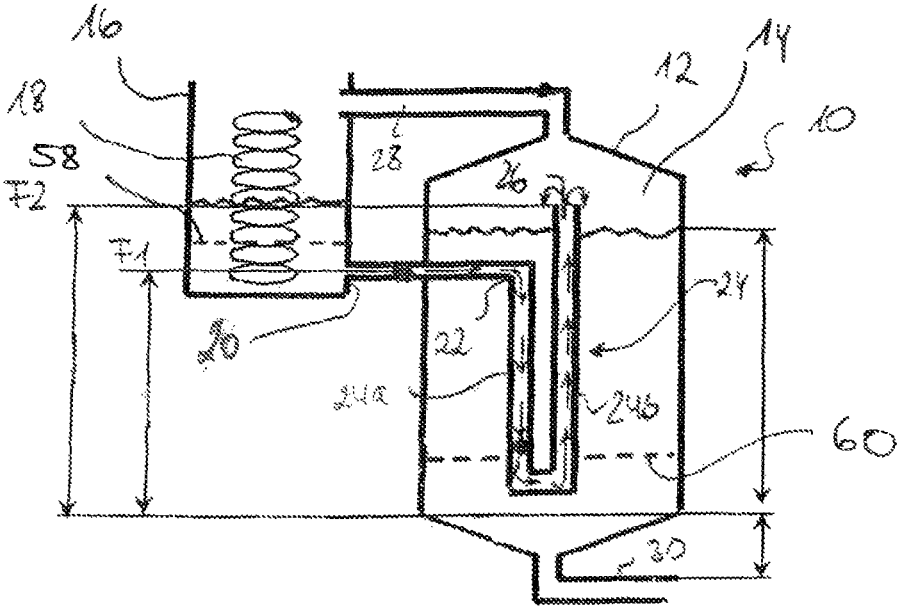
FIG. 10 shows a tenth embodiment of an accumulator arrangement suitable for use in a cooling system which is designed for operation with a two-phase refrigerating medium.

A tenth embodiment of an accumulator arrangement 10, shown in FIG. 10, differs from the system according to FIG. 1 in that the accumulator arrangement 10 further comprises a first separation sheet 58 which is arranged in the liquefier 16 so as to separate a first area 16*a* of the liquefier 16 from a second area 16*b* of the liquefier 16. The second area 16*b* of the liquefier 16 is arranged above the first area 16*a* of the liquefier 16, i.e. the first separation sheet 58 is arranged in the liquefier 16 such that the first separation sheet 58 forms a substantially horizontal separation between the first and the second area 16*a*, 16*b* of the liquefier 16 which extends below the surface of the liquid refrigerating medium in the liquefier 16. The first separation sheet 58 serves to separate a subcooled area of the liquefier 16, i.e. an area of the liquefier 16 which contains subcooled refrigerating medium, from the phase boundary between liquid refrigerating medium and vaporous refrigerating medium and hence enhances subcooling of the refrigerating medium in the liquefier 16.

The accumulator arrangement 10 further comprises a second separation sheet 60 which is arranged in the receptacle 14 of the accumulator vessel 12 so as to separate a first area of the receptacle 14*a* from a second area 14*b* of the receptacle 14. The second area 14*b* of the receptacle 14 is arranged above the first area 14*a* of the receptacle 14, i.e. the second separation sheet 60 is arranged in the receptacle 14 of the accumulator vessel 12 such that the second separation sheet 60 forms a substantially horizontal separation between the first and the second area 14*a*, 14*b* of the receptacle 14 which extends below the surface of the liquid refrigerating medium in the receptacle 14. The second separation sheet 60 serves to separate a subcooled area of the receptacle 14, i.e. an area of the receptacle 14 of the accumulator vessel 12 which contains subcooled refrigerating medium, from the phase boundary between liquid refrigerating medium and vaporous refrigerating medium and hence enhances subcooling of the refrigerating medium in the receptacle 14 of the accumulator vessel 12.

Both of the first and the second separation sheet 58, 60 are provided with a plurality of openings allowing a flow of liquid refrigerating medium between the first and the second area 16*a*, 16*b* of the liquefier 16 and the first and the second area 16*a*, 16*b* of the receptacle 14 of the accumulator vessel 12, respectively. Otherwise, the structure and mode of operation of the accumulator arrangement 10 according to FIG. 10 correspond to the structure and mode of operation of the arrangement shown in FIG. 1.

The embodiments of an accumulator arrangement 10 which are shown in FIGS. 2 to 9*b*, likewise, may comprise at least one separation sheet as described above. The at least one separation sheet may be arranged in at least one of the liquefiers 16, 34 and/or in at least one of the receptacles 14, 42 of the accumulator vessels 12, 40.

Features which are described here in relation to individual embodiments of the accumulator arrangement 10 can of course also be implemented in other embodiments of the accumulator arrangement. Consequently, features which are described in relation to specific embodiments of the accumulator arrangement can be transferred to other embodiments of the accumulator arrangement, in any combination.

What is claimed is:

1. An accumulator arrangement, for use in a cooling system which is designed for operation with a two-phase refrigerating medium, comprising:

an accumulator vessel with a receptacle for receiving a refrigerating medium;

a liquefier adapted to liquefy refrigerating medium to be received in the receptacle of the accumulator vessel before it is fed into the receptacle of the accumulator vessel, and which includes a refrigerating medium outlet for discharging the refrigerating medium liquefied in the liquefier;

a heat exchanger arranged in the receptacle of the accumulator vessel, and which includes a refrigerating medium inlet which is directly connected to the refrigerating medium outlet of the liquefier via a connecting pipe for feeding the refrigerating medium liquefied in the liquefier into the heat exchanger, and a refrigerating medium outlet which opens into the receptacle of the accumulator vessel, for discharging the refrigerating medium from the heat exchanger into the receptacle of the accumulator vessel;

a vent pipe directly connecting the receptacle of the accumulator vessel to the interior of the liquefier such that the accumulator vessel is vented via the vent pipe into the interior of the liquefier; and a first separation sheet arranged in the liquefier so as to separate a first area of the liquefier from a second area of the liquefier, the second area of the liquefier being arranged above the first area of the liquefier;

wherein the first separation sheet is below the surface of the refrigerating medium in the liquefier.

2. The accumulator arrangement according to claim 1, wherein the refrigerating medium outlet of the liquefier is arranged in the region of a sump of the liquefier, and the refrigerating medium outlet of the liquefier and the refrigerating medium inlet of the heat exchanger are arranged at the same height relative to each other, and/or wherein the refrigerating medium outlet of the heat exchanger is arranged above the refrigerating medium outlet of the liquefier.

3. The accumulator arrangement according to claim 1, wherein the heat exchanger comprises a first section and a second section which is arranged downstream from the first section, the first section of the heat exchanger being arranged below the refrigerating medium outlet of the liquefier, so that the refrigerating medium which is fed from the refrigerating medium outlet of the liquefier into the heat exchanger can flow through the first section of the heat exchanger in a first direction, driven by gravity, and the second section of the heat exchanger being positioned relative to the first section of the heat exchanger so that the refrigerating medium can flow through it in a second direction opposite to the first direction.

4. The accumulator arrangement according to claim 1, further comprising a further accumulator vessel with a receptacle for receiving a refrigerating medium, and a further heat exchanger which is arranged in the receptacle of the further accumulator vessel, wherein a refrigerating medium inlet of the further heat exchanger is connected to a sump of the accumulator vessel, and a refrigerating medium outlet of the further heat exchanger opens into the receptacle of the further accumulator vessel.

5. The accumulator arrangement according to claim 1, further comprising a further accumulator vessel with a receptacle for receiving a refrigerating medium, and a further heat exchanger which is arranged in the receptacle of the further accumulator vessel, wherein a refrigerating medium inlet of the further heat exchanger is connected to the refrigerating medium outlet of the liquefier, a refrigerating medium outlet of the further heat exchanger is connected to the refrigerating medium inlet of the heat exchanger, and a sump of the accumulator vessel is connected to a sump of the further accumulator vessel, to transfer refrigerating medium received in the receptacle of the accumulator vessel out of the receptacle of the accumulator vessel into the receptacle of the further accumulator vessel.

6. The accumulator arrangement according to claim 1, further comprising a further accumulator vessel with a receptacle for receiving a refrigerating medium, and a further heat exchanger which is arranged in the receptacle of the further accumulator vessel, wherein a refrigerating medium inlet of the further heat exchanger is connected to a further refrigerating medium outlet of the liquefier, and a refrigerating medium outlet of the further heat exchanger opens into the receptacle of the further accumulator vessel, in particular a sump of the accumulator vessel being connected to a sump of the further accumulator vessel, in order to transfer refrigerating medium received in the receptacle of the accumulator vessel from the receptacle of the accumulator vessel into the receptacle of the further accumulator vessel.

7. The accumulator arrangement according to claim 1, further comprising a further accumulator vessel with a receptacle for receiving a refrigerating medium, and a further heat exchanger which is arranged in the receptacle of the further accumulator vessel, wherein a refrigerating medium inlet of the further heat exchanger is connected to the refrigerating medium outlet of the liquefier, and a refrigerating medium outlet of the further heat exchanger opens into the receptacle of the further accumulator vessel, the refrigerating medium inlet of the heat exchanger being connected to the further heat exchanger upstream from the refrigerating medium outlet of the further heat exchanger, and the refrigerating medium outlet of the further heat exchanger being arranged below the refrigerating medium outlet of the heat exchanger.

8. The accumulator arrangement according to claim 1, further comprising a further liquefier, which is adapted to liquefy the refrigerating medium to be received in at least one of the receptacle of the accumulator vessel and a receptacle of a further accumulator vessel before it is fed into at least one of the receptacle of the accumulator vessel and the receptacle of the further accumulator vessel; and a refrigerating medium outlet which is connected directly to at least one of the receptacle of the accumulator vessel and the receptacle of the further accumulator vessel, so as to discharge the refrigerating medium liquefied in the further liquefier from the further liquefier into at least one of the receptacle of the accumulator vessel and the receptacle of the further accumulator vessel.

9. The accumulator arrangement according to claim 1, wherein a receptacle of a further accumulator vessel is connected via a further vent pipe to an interior of the liquefier, and/or wherein at least one of the receptacle of the accumulator vessel and the receptacle of the further accumulator vessel is connected via a recirculation conduit to an interior of the liquefier.

10. The accumulator arrangement according to claim 1, wherein the heat exchanger has, upstream from its refrigerating medium outlet, an opening, or multiple openings which open(s) into the receptacle of the accumulator vessel at different heights, and/or wherein a further heat exchanger has, upstream from its refrigerating medium outlet, an opening, or multiple openings which open(s) into the receptacle of a further accumulator vessel at different heights.

11. The accumulator arrangement according to claim 1, further comprising a second separation sheet which is arranged in the receptacle of the accumulator vessel so as to separate a first area of the receptacle from a second area of the receptacle, the second area of the receptacle being arranged above the first area of the receptacle.

12. The accumulator arrangement according to claim 11, wherein at least one of the first and the second separation sheet is provided with at least one opening.

13. A method for operating an accumulator arrangement, suitable for use in a cooling system which is designed for operation with a two-phase refrigerating medium, the method comprising:

liquefying refrigerating medium which is to be received in a receptacle of an accumulator vessel in a liquefier;

feeding the refrigerating medium liquefied in the liquefier through a refrigerating medium outlet of the liquefier into a heat exchanger which is arranged in the receptacle of the accumulator vessel;

discharging the refrigerating medium from the heat exchanger into the receptacle of the accumulator vessel through a refrigerating medium outlet of the heat exchanger; and venting the receptacle of the accumulator vessel via a vent pipe into the interior of the liquefier, wherein a substantially horizontal separation sheet extends below the surface of the refrigerating medium in the liquefier.

14. The method according to claim 13, wherein the refrigerating medium liquefied in the liquefier is fed out of the liquefier into the heat exchanger through a refrigerating medium outlet of the liquefier, the refrigerating medium outlet being arranged in a region of a sump of the liquefier, wherein the refrigerating medium liquefied in the liquefier is fed out of the liquefier into the heat exchanger through a refrigerating medium outlet of the liquefier, the refrigerating medium outlet being arranged at the same height as a refrigerating medium inlet of the heat exchanger, and/or wherein the refrigerating medium is discharged from the heat exchanger into the receptacle of the accumulator vessel through a refrigerating medium outlet of the heat exchanger, which is arranged above the refrigerating medium outlet of the liquefier.

15. The method according to claim 13, wherein the heat exchanger comprises a first section and a second section arranged downstream from the first section, wherein the refrigerating medium which is fed from the refrigerating medium outlet of the liquefier into the heat exchanger flows through the first section of the heat exchanger in a first direction, driven by gravity, and wherein refrigerating medium flows through the second section of the heat exchanger in a second direction opposite to the first direction.

16. The method according to claim 13, further comprising:

feeding refrigerating medium from a sump of the accumulator vessel into a further heat exchanger; and discharging refrigerating medium from the further heat exchanger into a receptacle of a further accumulator vessel.

17. The method according to claim 13, further comprising:

feeding refrigerating medium liquefied in the liquefier into a further heat exchanger;

discharging the refrigerating medium from the further heat exchanger into the heat exchanger; and feeding refrigerating medium from a sump of the accumulator vessel into a sump of a further accumulator vessel.

18. The method according to claim 13, further comprising:

feeding refrigerating medium liquefied in the liquefier into a further heat exchanger; and discharging the refrigerating medium from the further heat exchanger into a receptacle of a further accumulator vessel, wherein, the refrigerating medium from a sump of the accumulator vessel is transferred into a sump of the further accumulator vessel.

19. The method according to claim 13, further comprising:

feeding refrigerating medium liquefied in the liquefier into a further heat exchanger; and discharging the refrigerating medium from the further heat exchanger into a receptacle of a further accumulator vessel, wherein the refrigerating medium is fed from the further heat exchanger into the heat exchanger upstream from a refrigerating medium outlet of the further heat exchanger, the refrigerating medium outlet of the further heat exchanger being arranged below the refrigerating medium outlet of the heat exchanger.

20. The method according to claim 13, wherein the refrigerating medium to be received in at least one of the receptacle of the accumulator vessel and a receptacle of a further accumulator vessel is liquefied by a further liquefier, wherein the refrigerating medium liquefied by the further liquefier is fed directly into at least one of the receptacle of the accumulator vessel and the receptacle of the further accumulator vessel.

21. The method according to claim 13, wherein a receptacle of a further accumulator vessel is vented via a further vent pipe which is connected to the interior of the liquefier, and/or wherein the refrigerating medium is recirculated from at least one of the receptacle of the accumulator vessel and the receptacle of the further accumulator vessel into the interior of the liquefier, via a recirculation conduit which is connected to the interior of the liquefier.

22. The method according to claim 13, wherein the refrigerating medium is fed from the heat exchanger into the receptacle of the accumulator vessel through multiple openings of the heat exchanger, the openings opening at different heights into the receptacle of the accumulator vessel upstream from a refrigerating medium outlet of the heat exchanger, and/or wherein the refrigerating medium is fed from a further heat exchanger into a receptacle of a further accumulator vessel through multiple openings of the further heat exchanger, the openings opening at different heights into the receptacle of the further accumulator vessel upstream from a refrigerating medium outlet of the further heat exchanger.

23. An aircraft comprising an accumulator arrangement according to claim 1.

24. The method according to claim 13, wherein a further substantially horizontal separation sheet in the receptacle separates a subcooled area of the receptacle from the phase boundary between liquid refrigerating medium and vaporous refrigerating medium.

25. The accumulator arrangement according to claim 11, wherein the second separation sheet is below a surface of the refrigerating medium in the receptacle.

26. The method according to claim 13, wherein the substantially horizontal separation sheet in the liquefier separates a subcooled area of the liquefier from the phase boundary between liquid refrigerating medium and vaporous refrigerating medium.

* * * * *